US005451159A

United States Patent [19]

Kim

[11] Patent Number: 5,451,159

[45] Date of Patent: Sep. 19, 1995

[54] GAS LIGHTER WITH SAFETY DEVICE TO PREVENT RELEASE OF GAS

[76] Inventor: Jin K. Kim, c/o Bultina America Corp., 2334 E. Valencia Dr., Fullerton, Calif. 92631

[21] Appl. No.: 275,142

[22] Filed: Jul. 14, 1994

[51] Int. Cl.[6] ..... F23D 11/36

[52] U.S. Cl. ..... 431/153; 431/277

[58] Field of Search ..... 431/153, 276, 277

[56] References Cited

U.S. PATENT DOCUMENTS

| | | | |
|---|---|---|---|
| 3,898,031 | 8/1975 | Rusakowicz . | |
| 4,784,601 | 11/1988 | Nitta . | |
| 4,784,602 | 11/1988 | Nitta . | |
| 4,786,248 | 11/1988 | Nitta . | |
| 4,830,603 | 5/1989 | Cirami . | |
| 4,832,596 | 5/1989 | Morris, Sr. . | |
| 4,859,172 | 8/1989 | Nitta . | |
| 4,904,180 | 2/1990 | Nitta . | |
| 5,002,482 | 3/1991 | Fairbanks et al. . | |
| 5,074,781 | 12/1991 | Fujita . | |
| 5,090,893 | 2/1992 | Floriot . | |
| 5,145,358 | 9/1992 | Shike et al. . | |
| 5,186,618 | 2/1993 | Shike et al. . | |
| 5,205,729 | 4/1993 | Iwahori | 431/276 |
| 5,334,011 | 8/1994 | Frigiere | 431/153 |

FOREIGN PATENT DOCUMENTS

| | | |
|---|---|---|
| 0345729 | 12/1989 | European Pat. Off. . |
| 0488158 | 6/1992 | European Pat. Off. . |
| 62-180244 | 8/1987 | Japan . |
| 62-180247 | 8/1987 | Japan . |
| 63-142562 | 6/1988 | Japan . |
| 1178456 | 7/1989 | Japan . |
| 325215 | 2/1991 | Japan . |

*Primary Examiner*—Carroll B. Dority

[57] ABSTRACT

A safety device in a gas lighter to prevent release of gas fuel stored in the lighter when a safety button is in a locked position to thereby prevent ignition of the lighter, and to allow release of gas fuel when the safety button is moved from the locked position to an unlocked position. An indentation in the safety button coacts with an end portion of a housing of the lighter to releasably retain the safety button in the unlocked position when moved there by a user's finger. Projections provided on the underside of a gas-release button guide the safety button's movement between the locked and unlocked positions and releasably retain the safety button in the unlocked position. The safety button is moved from the unlocked to the locked position when the gas-release button is released after ignition of the lighter.

15 Claims, 4 Drawing Sheets

FIG. 3
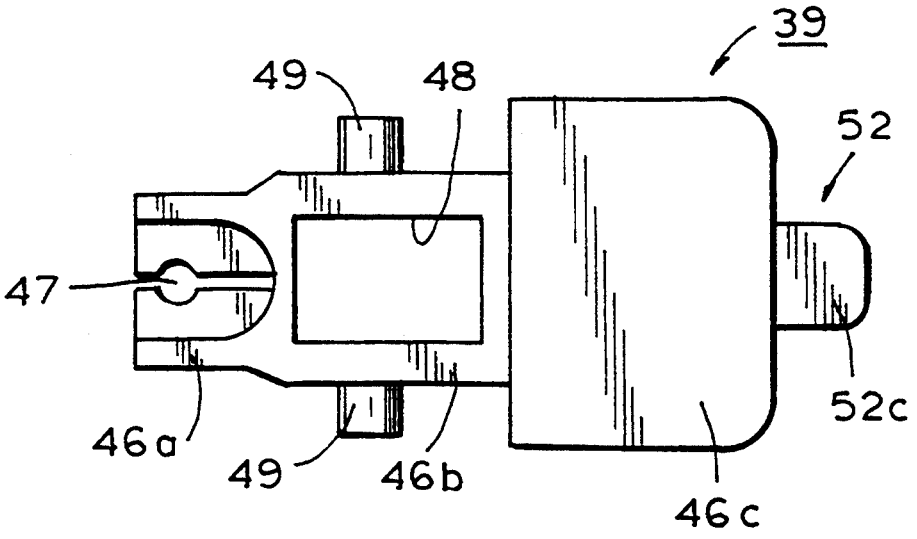
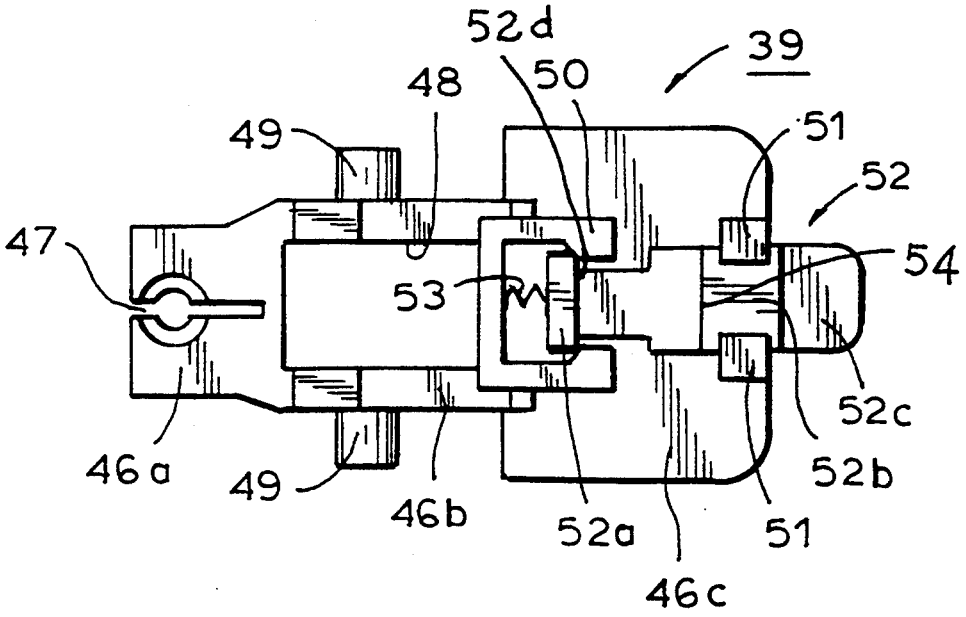
FIG. 4

FIG. 5
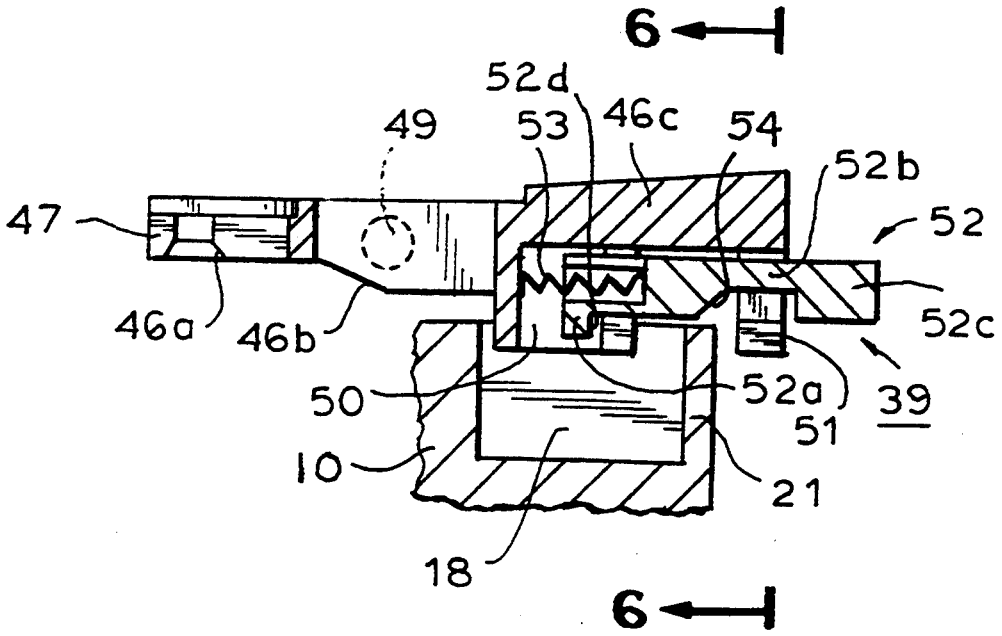
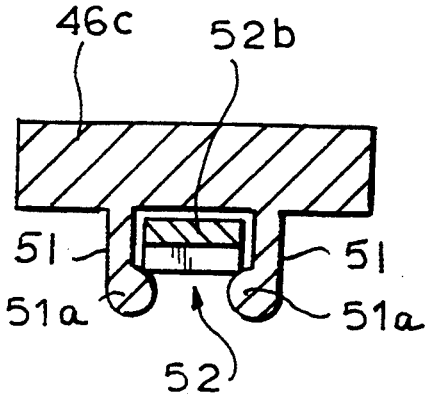
FIG. 6

GAS LIGHTER WITH SAFETY DEVICE TO PREVENT RELEASE OF GAS

BACKGROUND OF THE INVENTION

1. Field of the Invention

The present invention relates to a gas lighter having a safety device which prevents inadvertent ignition of the lighter. In particular, when in a locked position the safety device prevents the release of gas fuel so that the lighter cannot be ignited.

2. DESCRIPTION OF RELATED ART

Commercially available gas lighters are dangerous if handled carelessly, particularly by young children. The inadvertent ignition of such gas lighters has resulted in fires causing property damage and injury to people. Furthermore, in most of the gas lighters that are available, the gas-release button is normally located on the outside of the case. In these lighters gas fuel can be accidentally released while the lighter is being carried. Therefore, there is a need for a safety device, which in a locked position prevents the inadvertent release of gas fuel and also makes the lighters difficult for children to operate. Gas lighters sold in commerce are now required by federal law to have ignition safety devices to prevent young children from being able to ignite the lighters.

U.S. Pat. No. 5,002,482, to Fairbanks et al., discloses a safety device with a safety latch that prevents movement of an actuator means for releasing fuel stored in the lighter. When fuel is to be released to ignite the lighter, the safety latch is moved cross-wise and upwards towards a guide notch in the actuator means, thereby allowing movement of the actuator means to release the fuel.

This lighter, however, is complicated to manufacture because a portion of the housing and the actuator means must be cut out to form the guide notch for movement of the safety latch. Moreover, the lighter is overly difficult to use because of the multiple directions and forces required to release the safety latch.

SUMMARY OF THE INVENTION

It is an object of the present invention to provide gas lighters with a safety device which in a locked position reliably prevents the release of gas fuel.

It is another object of the present invention to equip such lighters with a safety device which prevents the accidental release of gas fuel.

It is yet another object of the present invention to provide a safety device which, although easy for adults to operate, reliably prevents young children from inadvertently igniting the lighters.

These and other objects are achieved in accordance with the present invention by a gas lighter which includes a housing having a reservoir for gas fuel and ignition means provided at one end of the housing. The ignition means includes a valve mechanism in fluid connection with the reservoir and operable for selectively discharging gas fuel stored in the reservoir through the valve mechanism; an ignition mechanism for igniting the gas fuel discharged through the valve mechanism; and gas-release means connected to the valve mechanism and supported by means on the housing to be moveable in a direction relative to the housing between a first position where gas is not discharged through the valve mechanism and a second position where gas is discharged through the valve mechanism. The safety device, which is provided at the one end of the housing, includes a safety button structured and arranged for movement in the direction relative to the housing between a locked position, where the safety button prevents the movement of the gas-release means, and an unlocked position where the movement of the gas-release button from the first position to the second position is not prevented, and retaining means for releasably retaining the safety button in the unlocked position including a first part and a second part, the first part and the second part being located relative to each other such that the first and second part engage each other when the safety button is moved toward the unlocked position to releasably retain the safety button in the unlocked position. The safety device also includes means for moving the safety button from the unlocked position toward the locked position. The means for moving engages the safety button when the gas-release means is moved from the first position toward the second position, and then moves the safety button toward the locked position when the gas-release means is moved from the second position toward the first position.

Advantageously, in a gas lighter according to the present invention the gas-release button has an underside and a pair of downwardly extending projections are provided at the underside of the gas-release button. The projections are spaced apart from each other to define a space therebetween, and a safety button disposed in the space between the projections is movable between a locked position, where the safety button prevents the movement of the gas-release button from the first position to the second position, and an unlocked position where the movement of the gas-release button from the first position to the second position is not prevented. Means are provided on the projections for releasably retaining the safety button in the unlocked position, and for moving the safety button toward the locked position, when the gas-release button is moved from the gas-releasing second position toward the first position at which gas is not released, so that the safety button is returned to its locked position.

As used herein, ignition mechanism includes any suitable ignition mechanism, such as a piezoelectric ignition mechanism, a flint-type ignition mechanism or the like; a reservoir includes any suitable reservoir for storing fuel for the lighter, such as gas fuel for a gas lighter; and a valve mechanism includes a suitable valve mechanism for controlling the release of the fuel from the reservoir.

The inventor has found that gas lighters equipped with the safety device of the present invention are difficult to ignite when young children are asked to try to do so. Therefore, if a lighter is left unattended a young child will encounter difficulty in releasing gas fuel due to the locking action of the safety button and the effort required to move it to the unlocked position. A young child may be able to produce a spark by turning the spark-producing wheel or the like but will not be able to produce a flame. Gas fuel will not be released due to the action of the safety device which prevents the gas-release button from being depressed, thereby preventing the release of gas fuel through the valve mechanism.

Advantageously, the safety button automatically returns to its locked position once the gas-release button is released. Thus, the lighter is maintained in a locked mode when not in use thereby preventing the inadvertent release of gas fuel.

Other features and advantages of the present invention will become apparent from the following description of the invention which refers to the accompanying drawings.

BRIEF DESCRIPTION OF THE DRAWINGS

FIG. 3 is a top plan view of the gas-release button and the safety button shown in FIG. 2 with other portions of the lighter removed for the sake of clarity;

FIG. 4 is a bottom plan view of the gas-release button and safety button shown in FIG. 3;

FIG. 5 is a sectional view along line 5—5 of FIG. 2 with portions of the lighter removed for the sake of clarity;

FIG. 6 is a sectional view along line 6—6 of FIG. 5 with portions of the lighter removed for the sake of clarity;

DETAILED DESCRIPTION OF A PREFERRED EMBODIMENT OF THE INVENTION

Figure 1:
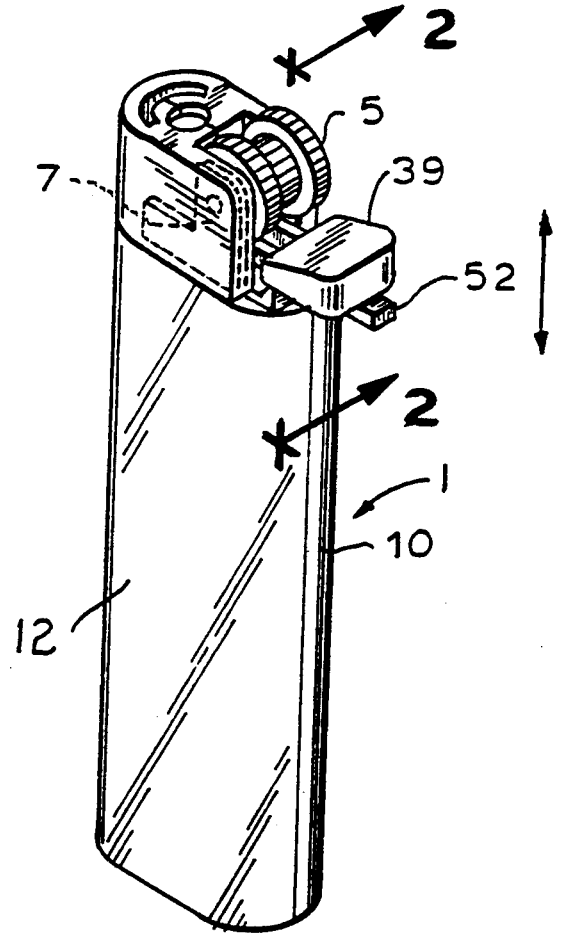
FIG. 1 is a perspective view showing a gas lighter according to an embodiment of the present invention.

FIG. 1 shows a lighter 1 illustrating certain principles of the invention, which has a housing 10 and a flint-type spark producing wheel 5 at its upper end. A gas-release button 39, and a safety button 52 located below the gas-release button 39 are also located at the upper end of the housing 10. As shown by arrows in FIG. 1, the gas-release button 39 and the safety button 52 are movable upwardly/downwardly in a vertical direction relative to the housing 10. In the upwards position, the safety button 52 is in a locked position where it prevents the gas-release button 39 from being depressed to release gas fuel, as discussed in further detail below.

Figure 2:
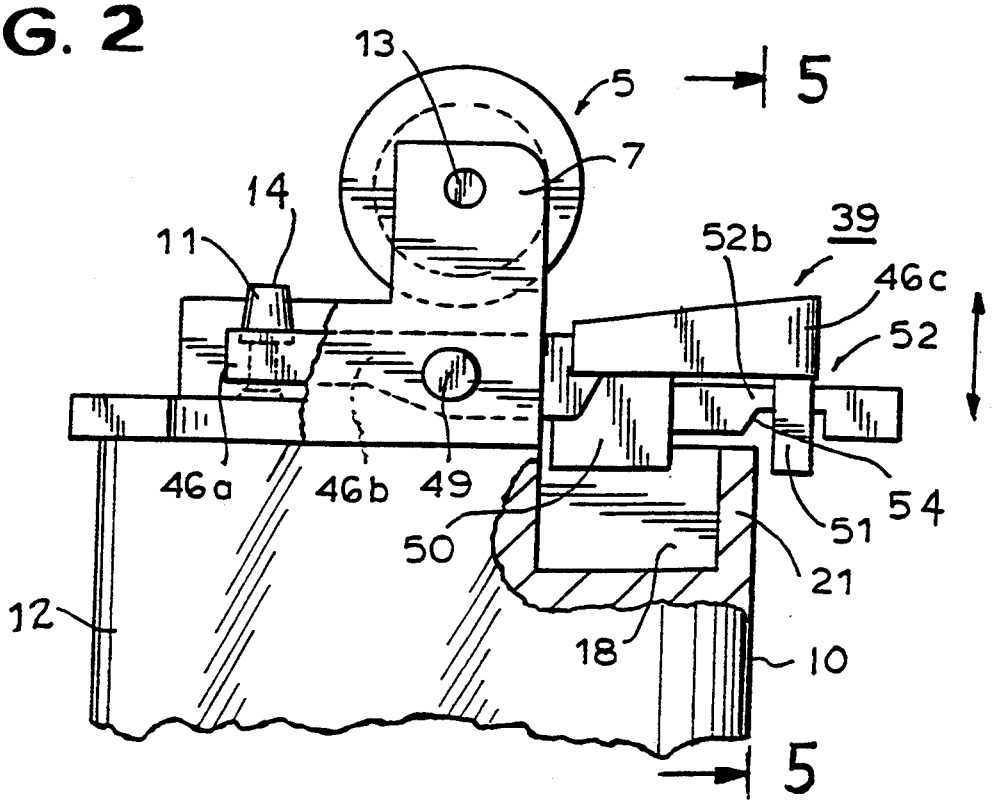
FIG. 2 is a fragmentary sectional view along line 2—2 of FIG. 1 showing a gas-release button and a safety button of the lighter in a locked position.

Referring to FIG. 2, the housing 10 includes a conventional gas fuel reservoir 12 for storing gas fuel therein. A conventional valve mechanism 11 located at the upper end of the housing 10 is in fluid connection with the reservoir 12 to selectively discharge the gas fuel stored in the reservoir 12 through an outlet 14 of the valve mechanism 11. Any conventional valve mechanism that is suitable may be used.

Figure 7:
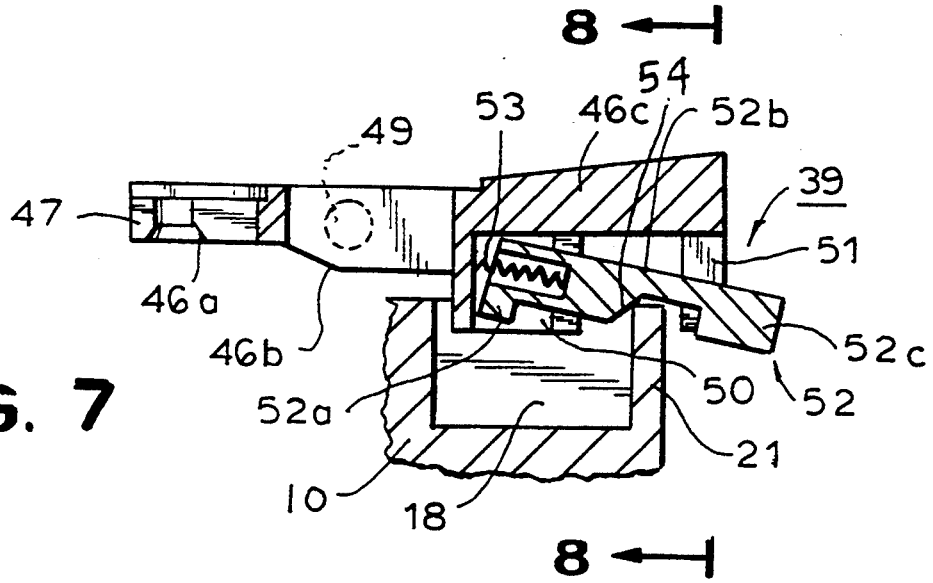
FIG. 7 is a sectional view similar to FIG. 5 showing the safety button in the unlocked position and the gas-release button in a raised position at which gas fuel is not released.
Figure 8:
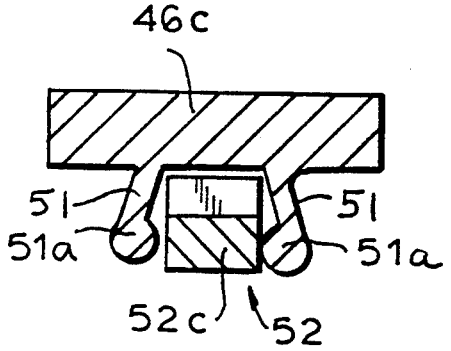
FIG. 8 is a sectional view along line 8—8 of FIG. 7, with portions of the lighter removed for the sake of clarity, showing the safety button in the unlocked position and the gas-release button in a raised position at which gas fuel is not released.
Figure 9:
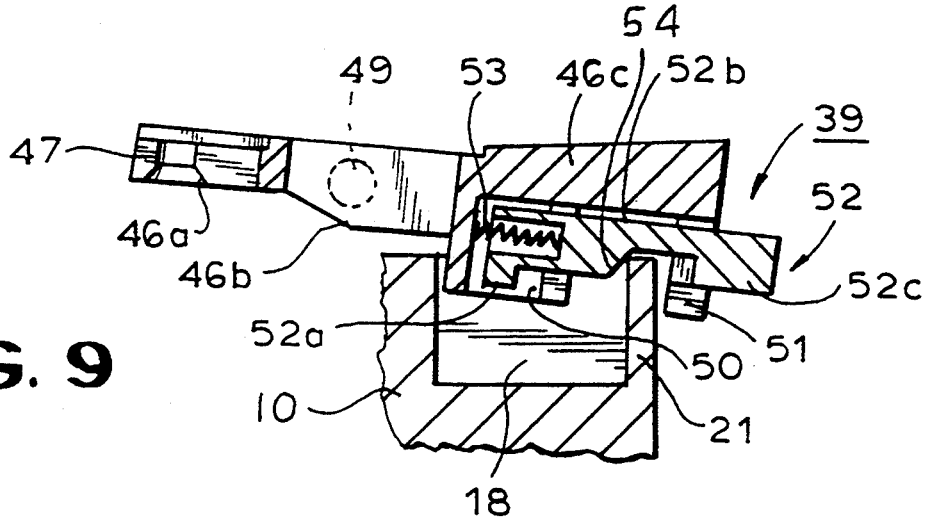
FIG. 9 is a sectional view similar to FIGS. 5 and 7 showing the safety button in the unlocked position and the gas-release button in a depressed position at which gas fuel is released so that the lighter can be ignited.

The wheel 5 is rotatably retained at the upper end of the housing 10 by upwardly projecting arms 7 provided on the housing 10. The flint-type spark producing wheel 5 is also conventional and, as is known, is rotatable about an axis 13 so as to coact with a flint (not shown) to produce a spark. Rotation of the wheel 5 ignites the gas fuel which is discharged through the outlet 14 of the valve mechanism 11 when the safety button 52 is moved downwardly from the locked position shown in FIG. 2 to an unlocked position (as shown in FIGS. 7–9) and then the gas-release button 39 is depressed (as shown in FIG. 9). However, when the safety button 52 is not first moved downwardly to the unlocked position the gas-release button 39 cannot be depressed so that gas fuel is not discharged. Therefore, if the wheel 5 is rotated with the safety button 52 in the locked position although a spark is produced the lighter cannot be ignited.

The gas-release button 39 extends horizontally from the valve mechanism 11 to beyond a vertical wall 21 of the housing 10. The gas-release button 39 includes an end portion **46*a*, an intermediate portion 46*b* and a button portion 46*c*, which extends partially beyond the wall 21 of the housing 10. Referring also to FIGS. 3 and 4, a longitudinally extending slot 47 is provided in the end portion 46*a* of the gas-release button 39. The slot 47 includes a circular portion for receiving the valve mechanism 11. The circular portion of the slot 47 grips a shoulder portion provided below the outlet 14 of the valve mechanism 11 (as shown in FIG. 2). The gas-release button 39 is pivotally supported via outwardly extending projections 49, which are attached to the intermediate portion 46*b* and which are journaled in the arms 7 so that the button portion 46*c* is downwardly pivotable by pressure from a user's finger, as shown by the arrows in FIGS. 1 and 2. A generally rectangular hole 48 is provide in the intermediate portion 46*b* of the gas-release button 39. A flint (not shown) passes through the hole 48 to coact with the wheel 5 to produce a spark when the wheel 5 is rotated. The button portion 46*c* of the gas-release button 39 is urged upwardly by a corresponding resistance to upward movement (i.e., movement to an open position) of the valve mechanism 11, to which the button portion 46*c* is connected by the intermediate portion 46*b* and the end portion 46*a* of the gas-release button 39. Accordingly, the button portion 46*c* is movable between a first, upward position and a second, downward position around the pivot axis provided by the projections 49. In the upward position of the button portion 46*c* (shown in FIGS. 2 and 5–8), gas fuel is not discharged through the outlet 14 of the valve mechanism 11. When the button portion 46*c* is depressed downwardly (as shown in FIG. 9), gas fuel is discharged through the outlet 14 of the valve mechanism 11. On the underside of the button portion 46*c*, at the part extending beyond the vertical wall 21 of the housing 10, a pair of downwardly extending fingers 51 are provided. The fingers 51 are spaced apart from each other to define a space therebetween (FIGS. 4, 6 and 8). As best seen in FIG. 6, the fingers 51 have rounded end portions 51*a*, which are closer to each other than are the remaining portions of the fingers 51** to each other.

As shown in FIGS. 2 and 4, the safety button 52 extends horizontally outwardly from a downwardly extending U-shaped wall 50, which is integrally formed with the underside of the button portion **46*c* of the gas-release button 39, to beyond an outer edge of the button portion 46*c*. As is evident from FIG. 2, the upwardly extending, vertical wall 21 of the housing 10 defines a space 18 below the safety button 52. The space 18 provides room for the downwardly movement of the gas-release button 39 and the safety button 52. As such, the safety button 52 moves in the same direction relative to the housing 10 as does the button portion 46*c* of the gas release button 39**.

As best seen in FIG. 4, the safety button 52 includes an end portion 52*a*, an intermediate portion 52*b* and a button portion 52*c*. The end portion 52*a* is located between side portions of the U-shaped, downwardly extending wall 50 of the gas release button 39. The end portion 52*a* has a shoulder portion 52*d*, which is wider than the gap formed by ends of the side portions of the U-shaped wall 50, which advantageously has ends turned inwardly toward each other. Accordingly, the shoulder portion 52*d* cooperates with ends of the U-shaped wall 50 to retain the safety button 52 in place against the outward pressure of a spring 53, which is provided between the end portion 52*a* of the safety button 52 and an inner side of the U-shaped wall 50. The spring 53 urges the safety button 52 outwardly relative to the gas-release button 39 and the housing 10. The outward pressure of the spring 53 pushes the safety button 52 toward its locked position. As shown in FIG. 5, in the locked position of the safety button 52 because of the outward pressure exerted by the spring 53 the intermediate portion 52*b* is positioned above the upwardly extending wall 21 of the housing 10. Therefore, if the button portion 46*c* of the gas-release button 39 is pressed downwardly when the safety button 52 is in the locked position, the intermediate portion 52*b* contacts the upwardly extending Wall 21 thereby preventing depression of the gas-release button 39 to release gas fuel. The intermediate portion 52*b* of the safety button 52 has a step 54 formed on its lower surface. When the safety button 52 is moved inwardly and downwardly against the pressure of the spring 53, the upwardly extending wall 21 moves along an edge of the step 54 so that the safety button 52 can be moved toward the unlocked position. In the unlocked position of the safety button 52 the spring 53 is compressed (as shown in FIGS. 7 and 9).

A user's finger contacts the button portion 52*c* of the safety button 52 in order to move the safety button 52 from its locked position to the unlocked position. As previously discussed, the upwards position of the safety button 52, shown in FIGS. 2, 5 and 6, is a locked position where the safety button 52 prevents downward movement of the gas-release button 39. Movement of the safety button 52 downwardly, in the direction shown by the arrow in FIG. 2, unlocks the safety button 52 so that, as shown in FIGS. 7 and 8, a gap is created between the underside of the button portion 46*c* of the gas-release button 39 and the upperside of the safety button 52 and therefore movement of the gas-release button 39 from the upraised position to the downwardly gas-releasing position is not prevented.

When the safety button 52 is in a locked position, a portion of the safety button 52 is positioned between the downwardly extending fingers 51 of the button portion 46*c* of the gas-release button 39. Advantageously, when the safety button 52 is in the locked position, the downwardly extending fingers 51 are positioned on both sides of the button portion 52*c* at or near where the intermediate portion 52*b* joins the button portion 52*c*. The fingers or projections 51 serve as guides for guiding the safety button 52 when it is moved upwardly and downwardly in the directions shown by the arrows in FIGS. 1 and 2. Interaction between the shoulder portion 52*d* and ends of the U-shaped wall 50, the outward pressure of the spring 53, and the guiding action of the fingers 51 combine to provide an arrangement for moving the safety button 52 downwardly and upwardly.

As shown in FIG. 6, in the locked position the safety button 52 is located above the rounded, end portions 51*a* of the downwardly extending fingers 51. As is evident from FIG. 6, the end portions 51*a* are closer to each other than are the remaining portions of the fingers 51 to each other. As shown in FIG. 7, when the button portion 52*c* of the safety button 52 is moved downwardly, the step 54 formed in the intermediate portion 52*b* engages the upper rim of the upwardly extending wall 21 of the housing 10. At this position, as shown in FIG. 8, the safety button 52 is located between the end portions 51*a* of the downwardly extending fingers 51, which therefore grip the safety button 52 to retain the safety button 52 in the unlocked position. The outwardly directed pressure of the spring 53 ensures that engagement between the step 54 and the upper rim of the wall 21 is maintained. Advantageously, the combination of contact between the upper rim of the wall 21 and the step 54 and contact between the end portions 51*a* of the downwardly extending fingers 51 and the button portion 52*c* retains the safety button 52 in the unlocked position. As shown in FIG. 9, when the gas-release button 39 is pressed downwardly, the end portions 51*a* of the downwardly extending fingers 51 also move downwardly to below the safety button 52. Since the safety button 52 is no longer held in the unlocked position by end portion 51*a* of the fingers 51, the compressed spring 53 pushes the safety button 52 outwardly relative to the gas-release button 39 and the housing 10. The engagement between the step 54 and the upper rim of the wall 21 is released by the outward movement of the safety button 52 under pressure of the spring 53. The safety button 52 is then free to return to its upward, locked position. Advantageously, the step 54 is provided with an inclined surface so that when the safety button 52 moves into the space between the fingers 51, engagement between the step 54 and the upper rim of the wall 21 is released by the step 54 sliding off the upper rim of the wall 21 under the outwardly directed pressure of the spring 53. When the gas-release button 39 is then released after ignition of the lighter, it is urged upwardly by the resistance of the valve mechanism 11 and returns to its upraised position. Since the end portions 51*a* of the downwardly extending fingers 51 are below the button portion 52*c* of the safety button 52, the button portion 52*c* is also raised with the gas release button 39. In this manner, the safety button 52 returns to its locked position.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A gas lighter having a safety device to prevent ignition of the lighter, the gas lighter comprising:

(a) a housing including a reservoir for gas fuel;

(b) ignition means provided at one end of the housing, the ignition means including:

(A) a valve mechanism in fluid connection with the reservoir and operable for selectively discharging gas fuel stored in the reservoir through the valve mechanism;

(B) an ignition mechanism for igniting the gas fuel discharged through the valve mechanism; and (C) gas-release means connected to the valve mechanism and supported by means on the housing to be moveable relative to the housing between a first position where gas is not discharged through the valve mechanism and a second position where gas is discharged through the valve mechanism; and (c) a safety device at the one end of the housing, the safety device including:

(A) a safety button structured and arranged for movement relative to the housing between a locked position, where the safety button prevents the movement of the gas-release means, and an unlocked position where the movement of the gas-release means from the first position to the second position is not prevented;

(B) retaining means for releasably retaining the safety button in the unlocked position, the retaining means including a first part and a second part, the first part and the second part being located relative to each other such that the first and second part engage each other when the safety button is moved toward the unlocked position to releasably retain the safety button in the unlocked position; and (C) means for moving the safety button from the unlocked position toward the locked position, the means for moving engaging the safety button when the gas-release means is moved from the first position toward the second position, and then moving the safety button toward the locked position when the gas-release means is moved from the second position toward the first position, wherein the gas-release means has an underside, a pair of downwardly extending projections at the underside of the gas-release means, and the retaining means further comprising an end portion of the safety button and respective end portions of the projections at the gas-release means, the respective end portions of the projections engaging the end portion of the safety button for releasably retaining the safety button in the unlocked position.

2. A gas lighter having a safety device to prevent ignition of the lighter, the gas lighter comprising:

(a) a housing including a reservoir for gas fuel;

(b) ignition means provided at one end of the housing, the ignition means including:

(A) a valve mechanism in fluid connection with the reservoir and operable for selectively discharging gas fuel stored in the reservoir through the valve mechanism;

(B) an ignition mechanism for igniting the gas fuel discharged through the valve mechanism; and (C) gas-release means connected to the valve mechanism and supported by means on the housing to be moveable relative to the housing between a first position where gas is not discharged through the valve mechanism and a second position where gas is discharged through the valve mechanism; and (c) a safety device at the one end of the housing, the safety device including:

(A) a safety button structured and arranged for movement relative to the housing between a locked position, where the safety button prevents the movement of the gas-release means, and an unlocked position where the movement of the gas-release means from the first position to the second position is not prevented;

(B) retaining means for releasably retaining the safety button in the unlocked position, the retaining means including a first part and a second part, the first part and the second part being located relative to each other such that the first and second part engage each other when the safety button is moved toward the unlocked position to releasably retain the safety button in the unlocked position; and (C) means for moving the safety button from the unlocked position toward the locked position, the means for moving engaging the safety button when the gas-release means is moved from the first position toward the second position, and then moving the safety button toward the locked position when the gas-release means is moved from the second position toward the first position, wherein the gas-release means has an underside, a pair of downwardly extending projections at the underside of the gas-release means, the projections being spaced apart from each other to define a space therebetween, the safety button moving between the locked and the unlocked position in the space between the projections.

3. A gas lighter having a safety device to prevent ignition of the lighter, the gas lighter comprising:

(a) a housing including a reservoir for gas fuel;

(b) ignition means provided at one end of the housing, the ignition means including:

(A) a valve mechanism in fluid connection with the reservoir and operable for selectively discharging gas fuel stored in the reservoir through the valve mechanism;

(B) an ignition mechanism for igniting the gas fuel discharged through the valve mechanism; and (C) gas-release means connected to the valve mechanism and supported by means on the housing to be moveable relative to the housing between a first position where gas is not discharged through the valve mechanism and a second position where gas is discharged through the valve mechanism; and (c) a safety device at the one end of the housing, the safety device including:

(A) a safety button structured and arranged for movement relative to the housing between a locked position, where the safety button prevents the movement of the gas-release means, and an unlocked position where the movement of the gas-release means from the first position to the second position is not prevented;

(B) retaining means for releasably retaining the safety button in the unlocked position, the retaining means including a first part and a second part, the first part and the second part being located relative to each other such that the first and second part engage each other when the safety button is moved toward the unlocked position to releasably retain the safety button in the unlocked position;

(C) means for moving the safety button from the unlocked position toward the locked position, the means for moving engaging the safety button when the gas-release means is moved from the first position toward the second position, and then moving the safety button toward the locked position when the gas-release means is moved from the second position toward the first position; and (D) spring means located between the gas-release means and the safety button, the spring means urging the safety button outwardly relative to the gas-release means toward the locked position when the moving means moves the safety button toward the locked position.

4. A gas lighter having a safety device to prevent ignition of the lighter, the gas lighter comprising:

(a) a housing including a reservoir for gas fuel;

(b) ignition means provided at one end of the housing, the ignition means including:

(A) a valve mechanism in fluid connection with the reservoir and operable for selectively discharging gas fuel stored in the reservoir through the valve mechanism;

(B) an ignition mechanism for igniting the gas fuel discharged through the valve mechanism; and (C) gas-release means connected to the valve mechanism and supported by means on the housing to be moveable relative to the housing between a first position where gas is not discharged through the valve mechanism and a second position where gas is discharged through the valve mechanism; and (c) a safety device at the one end of the housing, the safety device including:

(A) a safety button structured and arranged for movement relative to the housing between a locked position, where the safety button prevents the movement of the gas-release means and an unlocked position where the movement of the gas-release means from the first position to the second position is not prevented;

(B) retaining means for releasably retaining the safety button in the unlocked position, the retaining means including a first part and a second part, the first part and the second part being located relative to each other such that the first and second part engage each other when the safety button is moved toward the unlocked position to releasably retain the safety button in the unlocked position; and (C) means for moving the safety button from the unlocked position toward the locked position, the means for moving engaging the safety button when the gas-release means is moved from the first position toward the second position, and then moving the safety button toward the locked position when the gas-release means is moved from the second position toward the first position, wherein the retaining means and the means for moving the safety button comprise a pair of downwardly extending projections at an underside of the gas-release means, the projections having respective end portions, and being spaced apart from each other to define a space therebetween.

5. A gas lighter having a safety device to prevent ignition of the lighter by preventing release of gas fuel stored in the lighter, the gas lighter comprising:

(a) a housing having a top end, a reservoir for gas fuel in the housing;

(b) a valve mechanism disposed at the top end of the housing and in fluid connection with the reservoir, the valve mechanism having an outlet and being operable for selectively discharging gas fuel stored in the reservoir through the outlet;

(c) an ignition mechanism at the top end of the housing, the ignition mechanism being operable for igniting the gas fuel discharged through the outlet of the valve mechanism;

(d) a gas-release button including an end portion connected to the valve mechanism, an intermediate portion having axis means for pivotably supporting the gas-release button at the top end of the housing, and a button portion for contact by a finger of a user, the button portion being movable between a first position where gas is not discharged through the outlet of the valve mechanism and a second position where gas is discharged through the outlet of the valve mechanism, the gas-release button having an underside and a pair of downwardly extending projections at the underside of the gas-release button, the projections being spaced apart from each other to define a space therebetween; and (e) a safety button disposed in the space between the projections, and being movable between a locked position, where the safety button prevents the movement of the gas-release button from the first position to the second position, and an unlocked position where the movement of the gas-release button from the first position to the second position is not prevented, means on the projections for releasably retaining the safety button in the unlocked position, and for moving the safety button toward the locked position when the gas-release button is moved from the second position toward the first position so that the safety button is returned to the locked position.

6. The gas lighter according to claim 3, wherein the first part of the retaining means is located at the safety button, and the second part is located at the housing.

7. The gas lighter according to claim 6, wherein the first part located at the safety button is a step provided at an underside of the safety button, the housing including a wall portion that extends upwardly at the one end of the housing and the second part is an edge at an upper rim of the wall.

8. The gas lighter according to claim 3, wherein the spring means is structured and arranged such that when the safety button is moved toward the unlocked position the first and second parts engage each other.

9. The gas lighter according to claim 3, wherein the gas-release means has an underside and a pair of downwardly extending projections are provided at the underside of the gas-release means, the projections being spaced apart from each other to define a space therebetween, the safety button moving between the locked and the unlocked position in the space between the projections.

10. The gas lighter according to claim 2, wherein the first part of the retaining means comprises an end portion of the safety button, and the second part comprises respective end portions of the projections at the gas-release means, the respective end portions of the projections engage the end portion of the safety button for releasably retaining the safety button in the unlocked position.

11. The gas lighter according to claim 2, wherein the means for moving comprises the projections at the underside of the gas-release means.

12. The gas lighter according to claim 2, wherein the safety device further includes spring means, the spring means being located between the gas-release means and the safety button, the spring means urging the safety button in an outwardly direction relative to the gas-release means such that when the safety button is moved by the moving means toward the locked position the safety button returns to the locked position, and such that when the safety button is moved toward the unlocked position the first and second part engage each other.

13. The gas lighter according to claim 3, wherein the means for moving the safety button is located at the gas-release button.

14. The gas lighter according to claim 3, wherein the gas-release means and the safety button are both movable along a same direction relative to the housing.

15. The gas lighter according to claim 3, wherein the first part of the retaining means is located at the safety button, and the second part is located at the gas-release means.

* * * * *